United States Patent [19]

Okutomi et al.

[11] 4,129,760

[45] Dec. 12, 1978

[54] VACUUM CIRCUIT BREAKER

[75] Inventors: Tsutomu Okutomi, Kawasaki; Hisashi Yoshino; Seishi Chiba, both of Yokohama, all of Japan

[73] Assignee: Tokyo Shibaura Electric Co., Ltd., Tokyo, Japan

[21] Appl. No.: 801,214

[22] Filed: May 27, 1977

[30] Foreign Application Priority Data

May 28, 1976 [JP] Japan ..... 51-61211

[51] Int. Cl.[2] ..... H01H 33/66

[52] U.S. Cl. ..... 200/144 B

[58] Field of Search ..... 200/144 B, 262, 265, 200/266

[56] References Cited

U.S. PATENT DOCUMENTS

| | | | |
|---|---|---|---|
| 2,975,256 | 3/1961 | Lee et al. | 200/144 B |
| 3,497,652 | 2/1970 | Horn et al. | 200/144 B |
| 3,551,622 | 12/1970 | Takeuchi et al. | 200/144 B |
| 3,770,497 | 11/1973 | Hassler et al. | 200/144 B |

FOREIGN PATENT DOCUMENTS

| | | | |
|---|---|---|---|
| 1025944 | 4/1966 | United Kingdom | 200/144 B |

*Primary Examiner*—Robert S. Macon

*Attorney, Agent, or Firm*—Oblon, Fisher, Spivak, McClelland & Maier

[57] ABSTRACT

A vacuum circuit breaker comprising an evacuated envelope and a pair of movable conductive rods within the envelope having points of contact equipped with contact members, wherein the conductive rods slide into and out of engaging contact, the improvement comprising at least one of said contacts having circuit-making and breaking members formed of an alloy consisting essentially of 4 wt% to 9.4 wt% aluminum, 0.5 wt% to 3.5 wt% of beryllium, 0.1 wt% to 10 wt% of $Me_1$, wherein $Me_1$ is at least one metal selected from the group consisting of bismuth, tellurium, selenium, antimony, magnesium and lead, and the balance copper.

4 Claims, 2 Drawing Figures

VACUUM CIRCUIT BREAKER

BACKGROUND OF THE INVENTION

1. Field of the Invention

The present invention relates to a vacuum circuit breaker and, more particularly, to a contact structure for such a breaker.

2. Description of the Prior Art

Generally, vacuum circuit breakers have three basic requirements which must be met. The first of these is that the circuit breaker must be capable of momentarily carrying current and closing against momentary current loads substantially in excess of the rated current capacity of the breaker without producing objectionable weld spots between the contacts of the breaker and without otherwise damaging the contacts of the breaker. The second requirement is that the breaker must be capable of breaking a current when overloaded. The third requirement is that the circuit breaker must be capable of withstanding, without damage or a disruptive discharge, an impulse crest voltage and a continuous A.C. voltage at the rated voltage of the device.

F. H. Horn et al., U.S. Pat. No. 3,586,803 and J. W. Porter et al. in U.S. Pat. No. 3,497,652, have proposed that the contacts of a vacuum breaker be formed of an alloy consisting of copper-beryllium-bismuth copper-aluminum-bismuth respectively. Vacuum breakers which have contacts of these alloys can interrupt high inductive current at rated voltages, can carry currents and close against such currents without producing objectionable contact-welds between the contacts, and can successfully withstand high impulse crest voltages of at least 95 KV and continuous 60 cycle voltages of at least 36 KV r.m.s. when the contacts are fully separated. Although such contacts are entirely satisfactory for many circuit applications, vacuum breakers whose contacts are formed of contact making and breaking regions of copper-aluminum-bismuth alloys as disclosed in the above-described patent have not been able to meet certain mechanical requirements. For instance, a mechanical property of vacuum breakers relates to the tendency of contacts to fracture by the application of an external mechanical force which is applied many times, thereby interrupting the operation of the device and through transient operations, as well as when a thermal force is imparted to the contacts and contact base when a device containing such contacts is used in welding processes, thereby being subjected to heat ranging from 600° to 800° C. Contact containing devices also encounter high temperatures of 400° to 600° C. employed in baking processes. Also, mechanical stress is imparted to such contact containing devices when cooled. Moreover, during manufacture of the vacuum breakers, the contacts exhibit the embrittlement phenomenon which reduces the eutectic modification of the alloy from the $\beta$ phase to the $\alpha + \gamma$ phase as the central structural feature of the natural alloy.

A need, therefore, continues to exist for an alloy material for vacuum circuit breakers whose contact points exhibit favorable mechanical characteristics.

SUMMARY OF THE INVENTION

Accordingly, one object of the present invention is to provide a vacuum breaker which has improved mechanical properties such as the ability to withstand the impacts of external forces without failure of the contacting-separating mechanism of the breaker under high voltage conditions.

Another object is to provide vacuum breaker contacts which do not exhibit embrittlement when subjected to a heat treatment process in the manufacture of the breakers such as a soldering or baking step.

Another object of the present invention is to provide an easy method of manufacture of a large capacity vacuum circuit breaker.

Briefly, these objects and other objects of the invention as hereinafter will become more readily apparent can be attained by a vacuum circuit breaker comprising an evacuated envelope and a pair of movable conductive rods within the envelope having points of contact equipped with contact members, wherein the conductive rods slide into and out of engaging contact, the improvement comprising at least one of said contacts having circuit-making and breaking members formed of an alloy consisting essentially of 4 wt% to 9.4 wt% aluminum, 0.5 wt% to 3.5 wt% of beryllium, 0.1 wt% to 10 wt% of $Me_1$, wherein $Me_1$ is at least one metal selected from the group consisting of bismuth, tellurium, selenium, antimony, magnesium and lead, and the balance copper.

In a preferred form of this invention, the alloy composition of the contact member contains nickel which is present in the quantity of between 1% and 20% by weight of the total composition, or contains iron or cobalt which is present in quantity of between 0.1% and 5% by weight of the total composition.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
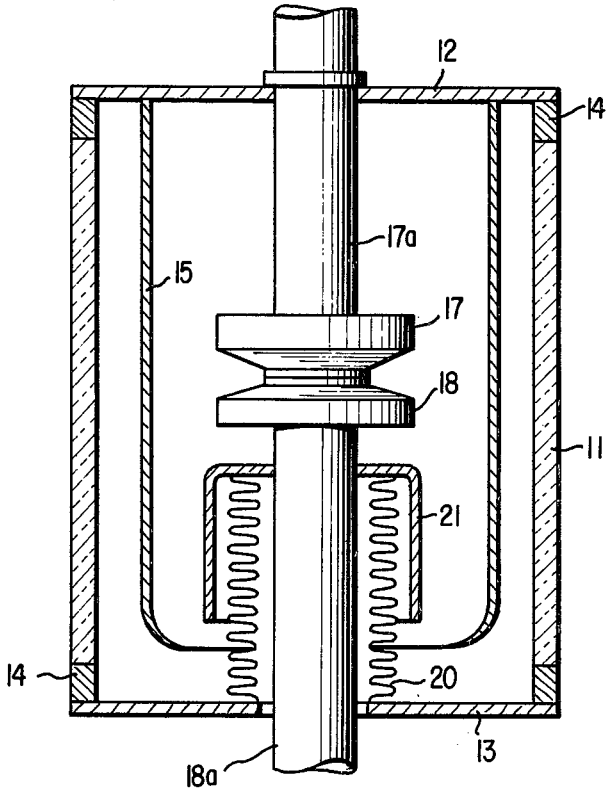
FIG. 1 is a sectional view of a vacuum circuit breaker which embodies one form of the present invention.

Referring now to the breaker of FIG. 1, a highly evacuated envelope 10 is shown which comprises a casing 11 of a suitable insulating material such as glass, and a pair of metallic end caps 12 and 13 which close off the ends of the casing. Suitable seals 14 are provided between the end caps and the casing 11 which render the envelope 10 vacuum-tight. The normal pressure within the envelope 10 under static conditions is less than $10^{-4}$ mmHg so that it can be reasonably assured that the mean free path for electrons will be longer than the potential breakdown paths in the envelope.

The internal insulating surfaces of casing 11 are protected from the condensation of arc-generated metal vapors thereon by means of a tubular metallic shield 15 suitably supported on the end cap 12 and preferably isolated from the end cap 13. This shield acts in a well known manner to intercept arc-generated metallic vapors before they can reach casing 11.

Located within the envelope 10 is a pair of separable contacts 17 and 18 which are shown in an engaged or closed-circuit position. The upper contact 17 is a stationary contact suitably attached to a conductive rod 17*a*, which at its upper end is united to the upper end cap 12. The lower contact 18 is a movable contact which is joined to a conductive operating rod 18*a* which is suitably mounted for vertical movement. Downward motion of contact 18 separates the contacts and opens the breaker, whereas the opposite return movement of contact 18 reengages the contacts and thus closes the breaker. A typical length of the gap of separation when the contacts are fully open is about 20 mm. The operating rod 18*a* projects through an opening in the lower end cap 13, and a flexible metallic bellows 20 provides a seal about the rod 18*a* to allow for vertical movement of the rod without impairing the vacuum inside the envelope 10. Metallic bellows 20 are suitably supported by metallic shield 21. As shown in FIG. 1, the bellows 20 are secured in a sealed relationship at their respective opposite ends to the operating rod 18*a* and the lower end cap 13.

Figure 2:
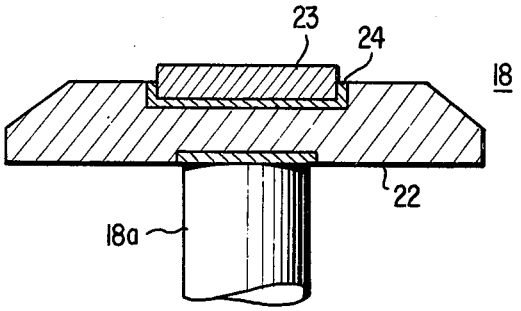
FIG. 2 is an enlarged perspective view of one of the contacts of the breaker of FIG. 1.

The configuration of the contacts of the present invention is not critical and is not limited to any particular contact configuration. For example, as shown in FIG. 2, the contact 18 is constructed of a disc-shaped base 22 which is soldered on the end of rod 18*a*, and which has a contact member 23 on its major surface facing the opposing contact. On the central region of each contact 22 is a contact member 23. The member 23 is fixed by solder 24 into the recess in the contact, thereby providing the contacts with circuit-making and circuit-breaking areas which abut against each other when the contacts are in their closed position. The contact members possess surface features which allow ready current flow through the closed contacts.

In the method of manufacture of the Cu - Al - Be - Bi alloy of the present invention, the Cu, Al, and Be constituents are melted and mixed together while in the molten state under vacuum conditions of about $10^{-5}$ mm Hg and a temperature of about 1200° C. Thereafter, Bi is added to the molten Cu - Al - Be alloy under an Ar atmosphere. Then, the temperature is lowered to cool the alloy, thereby causing the constituents to solidify into the cast and form of a solid alloy.

Having generally described this invention, a further understanding can be obtained by reference to certain specific examples which are provided herein for purposes of illustration only and are not intended to be limiting unless otherwise specified.

EXAMPLE

The measured results of various aspects and properties of several alloys within the scope of the present invention are shown in Table 1 in comparison to two conventional alloy contacts.

Table 1

| | | Alloys of the present invention | | | | | Conventional alloys | |
|---|---|---|---|---|---|---|---|---|
| | | Example 1 | Example 2 | Example 3 | Example 4 | Example 5 | −1 | −2 |
| constituents (weight percent) $Me_1$ | Al | 7.5 | 7.5 | 7.5 | 7.5 | 7.5 | 13 | — |
| | Be | 1.5 | 1.5 | 1.5 | 1.5 | 1.5 | — | 5.4 |
| | Bi | 0.5 | 0.5 | 0.5 | 0.5 | 0.5 | 0.5 | 0.5 |
| $Me_2$ | Ni | — | 9.0 | — | — | — | — | — |
| | Fe | — | — | 2.0 | — | 1.5 | — | — |
| | Co | — | — | — | 1.0 | 0.5 | — | — |
| | Cu | bal. | bal. | bal. | bal. | bal. | bal. | bal. |
| Vickers' hardness (Hv) | | 187 | 197 | 190 | 195 | 203 | >310 | 280 |
| Elongation percentage (%) | | 10.2 ~13.9 | 11.9 —12.3 | 10.7 ~12.8 | 11.0 ~1.32 | 11.2 ~13.1 | 0.8 | 1.5 |
| Tensile stress ($Kg/mm^2$) | | 78~82 | 78~79 | 78~80 | 78~80 | 78~82 | 20~24 | 70 |
| Specific electric conductivity (% IACS) | | 17.8 ~17.9 | 13.4 ~13.6 | 15.1 ~15.3 | 16.5 ~16.8 | 15.5 ~15.7 | 14~16 | 30~36 |
| Voltage stress (KV) | | 62~68 | 65~68 | 65~68 | 65~68 | 65~18 | 54~58 | 53~56 |

It can be observed from the data in Table 1 that the alloys of Examples 1 to 5 have desirable hardness and high elongation in comparison to the conventional alloys. The process of forming the contacts is relatively easy. Moreover, the voltage stress of the breakers of the present invention decreased by a factor of 20 to 30% in comparison to the conventional breakers.

The amount of contamination on the contact surface of the breakers was determined as shown in Table 2.

Table 2

| | immediately after polishing contact resistance (Ω) | contaminated portions (%) | mean value of contact resistance without contaminated portions (Ω) |
|---|---|---|---|
| Example 1 | 0.50 | 17 | 13.1 |
| Example 2 | 0.50 | 2 | 1.77 |
| Conventional 1 | 0.50 | 79 | 72. |
| Conventional 1 | 0.50 | 88 | 233. |

It is apparent from the data in Table 2 that the contact of examples 1 and 2 exhibit greatly improved contact resistance characteristics in comparison to the resistance characteristics of conventional contacts 1 and 2. The measured voltage stress values are the voltages at which sparking occurs when the applied voltage is gradually increased between a positive electrode of a Ni needle which is polished to a mirror-like finish by buffing and a contact of the present invention as the negative electrode which is polished to a mirror-like finish. The electrodes were positioned at a gap of a length of 0.5 mm. The contamination of the contact surfaces is the percentage of value obtained by measuring the contact resistance between the plane of a contact and a Pt probe which is pressed on the contact surface by a weight of 0.5 gr. The contact resistance is measured over the 100 point portion of the surface. The contaminated portions of the contact gave a contact resistance which appeared as an infinite ohm resistance value.

The reasons why the elemental components of the contact members of the present invention are limited to the defined ranges are as follows:

If the aluminum content is reduced below a quantity of 4 weight %, the dispersed region of the voltage stress values shown in Table 3 increases and metallographic crystalline material grows. If the quantity of Al is increased beyond 9.4 weight percent, processing becomes more difficult in order to obtain an alloy of the desired hardness. Then the productivity goes down. Accordingly, the content of aluminum in the composition ranges between 4% and 9.4% by weight of the total composition.

Table 3

| | Composition (wt%) | | | | voltage stress | Vikers' hardness | conductivity |
|---|---|---|---|---|---|---|---|
| | Al | Bi | Be | Cu | (KV) | (Hv) | (% IACS) |
| control-3 | 2.0 | 0.5 | 1.5 | bal. | 50~57 | 170 | 18.3~19.0 |
| example-6 | 4.0 | 0.5 | 1.5 | bal. | 58~62 | 196 | 18.2~18.5 |
| example-7 | 9.4 | 0.5 | 1.5 | bal. | 63~69 | 210 | 17.7~18.0 |
| control-4 | 11.8 | 0.5 | 1.5 | bal. | 65~72 | 422 | 15.8~16.2 |

If the Be content of the alloy is reduced below about 0.5% by weight, sufficient voltage stress and the desired degree of hardness of the alloy cannot be obtained, as shown in Table 4. If the Be content of the alloy is increased beyond about 3.5% by weight of the total amount, the process of making the contact becomes too difficult with the objective being the formation of a contact of greater hardness. Moreover, from the point of view of pollution, it is not desirable to use significant quantities of Be. Moreover, the beryllium in the contact can vaporize to harmful Be vapor in the breaker. However, the desired content of Be in the alloy ranges between 0.5% and 3.5% by weight of the total composition.

Table 4

| | Composition (wt.%) | | | | Voltage stress | Vicker's hardness | conductivity |
|---|---|---|---|---|---|---|---|
| | Al | Be | Bi | Cu | (KV) | (Hv) | (% IACS) |
| control-5 | 7.5 | — | 0.5 | bal. | 38~42 | 95 | 17.8~18.0 |
| control-6 | 7.5 | 0.2 | 0.5 | bal. | 45~51 | 105 | 16.6~17.5 |
| example-8 | 7.5 | 0.5 | 0.5 | bal. | 56~62 | 114 | 15.5~16.2 |
| example-1 | 7.5 | 1.5 | 0.5 | bal. | 62~68 | 187 | 17.8~17.9 |
| example-9 | 7.5 | 2.5 | 0.5 | bal. | 64~69 | 220 | 19.0~19.6 |
| example-10 | 7.5 | 3.5 | 0.5 | bal. | 54~60 | 271 | 17.2~17.5 |
| control-7 | 7.5 | 4.0 | 0.5 | bal. | 48~58 | 315 | 16.1~16.9 |

In the case of a Cu - Be - $Me_1$ - Ni - Al alloy, the $Me_1$ element is at least one metal selected from the group consisting of Bi, Se, Te, Se, Mg, and Pb, as is shown in example 2 of Table 1 and Table 2, the contamination of the contact surface is reduced and the voltage stress rises upon the addition of Ni to the alloy of the contact. If the quantity of Ni in the alloy is reduced below about 1% by weight, the contamination effects of the contact surface do not arise. If the quantity of Ni content is increased beyond about 20% by weight, the specific electric conductivity of the contact is reduced and segregation of phases occurs in the alloy. Accordingly, the content of Ni in the composition ranges between 1% and 20% by weight of total composition.

In the case of a Cu - Al - Be - $Me_1$ - $Me_2$ alloy, as is shown in examples 3–5 in Table 1, $Me_1$ is at least one metal selected from the group of Bi, Sb, Te, Se, Mg, and Pb, and the $Me_2$ metal is iron (Fe) and/or cobalt (Co). The voltage stress and the mechanical properties such as hardness and elongation percentage of the alloy containing iron and/or cobalt improves, as is shown by the data in Table 1. It has been observed that the metallographical structure of the alloy becomes fine. In case of an alloy which contains Fe and/or Co, if the amount of Fe and/or Co is reduced below about 0.1%, the micronized effect, i.e., the fineness, of the structure and the voltage improvement efficacy are insignificant. If the quantity of Fe and/or Co is increased beyond about 5%, segregation of phases tends to occur in the alloy. Accordingly, the content of $Me_2$ in the alloy is limited between 0.1% and 5% by weight of the total composition.

The $Me_1$ component which is used in the Cu - Al - Be - $Me_1$ system alloy, the Cu - Al - Be - Ni - $Me_1$ system alloy or the Cu - Al - Be - $Me_1$ - $Me_2$ system alloy may be at least one metal selected from the group of Bi, Sb, Te, Se, Mg, and Pb. By using an element $Me_1$ in the contact alloy, the weld resistance ability of the alloy which is determined as the force which is required for the separation of breaker contacts and the voltage stress values become excellent as shown by the results presented in Table 5. Preferably, the $Me_1$ component is Sb.

Table 5

| | Composition (wt%) | Voltage stress (KV) | Weld resistance (Kg) |
|---|---|---|---|
| example-8 | Cu-7.5Al-0.5Be-0.5Bi | 56~62 | 0~1 |
| example-11 | Cu-7.5Al-0.5Be-3.5Sb | 61~63 | 5~8 |
| example-12 | Cu-7.5Al-0.5Be-3.4Te | 58~60 | 1~10 |
| example-13 | Cu-7.5Al-0.5Be-1.9Se | 56~60 | 5~10 |
| example-14 | Cu-7.5Al-0.5Be-2.8Mg | 56~60 | 5~15 |
| example-15 | Cu-7.5Al-0.5Be-1.8Pb | 56~60 | 1~3 |

Having now fully described the invention, it will be apparent to one of ordinary skill in the art that many changes and modifications can be made thereto without departing from the spirit or scope of the invention as set forth herein.

What is claimed as new and intended to be secured by Letters Patent is:

1. In a vacuum electric circuit breaker, comprising an evacuated envelope and a pair of movable conductive rods within said envelope having points of contact equipped with contact members, wherein said conductive rods are movable into and out of engaging contact, the improvement comprising:

at least one of said contacts having circuit-making and breaking members formed of an alloy consisting essentially of 4 wt% to 9.4 wt% aluminum, 0.5 wt% to 3.5 wt% beryllium, 0.1 wt% to 10 wt.% $Me_1$, wherein $Me_1$ is at least one metal selected from the group consisting of bismuth, tellurium, selenium, antimony, magnesium, and lead, and the balance copper.

2. The vacuum electric circuit breaker of claim 1, wherein the $Me_1$ component is antimony.

3. In a vacuum electric circuit breaker, comprising an evacuated envelope and a pair of movable conductive rods within said envelope having points of contact equipped with contact members, wherein said conductive rods are movable into and out of engaging contact, the improvement comprising:

at least one of said contacts having circuit-making and breaking contact members formed of an alloy consisting essentially of 4 wt% to 9.4 wt% aluminum, 0.5 wt% to 3.5 wt% beryllium, 1 wt% to 20 wt% nickel, 0.1 wt% to 10 wt% $Me_1$, wherein said $Me_1$ component is at least one metal selected from the group consisting of bismuth, tellurium, selenium, antimony, magnesium, and lead, and the balance copper.

4. In a vacuum electric circuit breaker, comprising an evacuated envelope and a pair of movable conductive rods within said envelope having points of contact equipped with contact members, wherein said conductive rods are movable into and out of engaging contact, the improvement comprising:

an least one of said contacts having circuit-making and breaking contact members formed of an alloy consisting essentially of 4 wt% to 9.4 wt% aluminum, 0.5 wt% to 3.5 wt% beryllium, 0.1 wt% to 10 wt% of $Me_1$, wherein said $Me_1$ is at least one metal selected from the group consisting of bismuth, tellurium, selenium, antimony, magnesium and lead, 0.1 wt% to 5 wt% of $Me_2$ which is iron and/or cobalt, and the balance copper.

* * * * *